United States Patent [19]

Monteil

[11] 3,977,817

[45] Aug. 31, 1976

[54] ROTARY MACHINE

[76] Inventor: Jean Andre Monteil, rue de Provence, 71, 75009 Paris, France

[22] Filed: Oct. 23, 1973

[21] Appl. No.: 408,397

Related U.S. Application Data

[63] Continuation-in-part of Ser. No. 168,918, Aug. 4, 1971, abandoned.

[30] Foreign Application Priority Data

Nov. 2, 1971 United Kingdom ..... 36193/71

[52] U.S. Cl. ..... 418/196; 418/117; 418/141; 418/143; 418/191

[51] Int. Cl.[2] ..... F01C 1/08; F01C 19/04

[58] Field of Search ..... 418/191, 141, 143, 117, 418/142, 189, 190, 125, 135, 101, 196; 418/191, 141, 143, 117, 142, 189, 190, 125, 135, 101, 196, 225; 277/95, 53

[56] References Cited

UNITED STATES PATENTS

| | | | |
|---|---|---|---|
| 1,955,755 | 4/1934 | Macartney et al. | 418/191 X |
| 2,004,563 | 6/1935 | Bogoslowsky | 418/141 |
| 2,349,838 | 5/1944 | Alexandersson et al. | 418/141 X |
| 2,451,261 | 10/1948 | Warren et al. | 277/53 X |
| 2,655,112 | 10/1953 | White | 418/191 X |
| 2,690,869 | 10/1954 | Brown | 418/191 X |
| 2,722,201 | 11/1955 | Muse | 418/143 X |
| 2,751,846 | 6/1956 | Lapsley | 418/196 |
| 2,856,120 | 10/1958 | Fawzi | 418/141 |
| 2,935,027 | 5/1960 | Monteil | 418/143 X |
| 3,076,446 | 2/1963 | Lockhart | 418/101 X |

FOREIGN PATENTS OR APPLICATIONS

| | | | |
|---|---|---|---|
| 355,439 | 8/1931 | United Kingdom | 277/95 |

*Primary Examiner*—Carlton R. Croyle
*Assistant Examiner*—Michael Koczo, Jr.
*Attorney, Agent, or Firm*—Mason, Kolehmainen, Rathburn & Wyss

[57] ABSTRACT

A mechanical system for a rotary machine, which has a rotor and sets of abutments arranged around the rotor. The abutments are arranged to couple mechanically with the rotor and with separate consecutive variable volume channels or chambers of different pressures dividing a peripheral groove in the rotor by blades.

11 Claims, 14 Drawing Figures

ROTARY MACHINE

This application is a continuation-in-part of U.S. Pat. application, Ser. No. 168918, filed Aug. 4, 1971, and now abandoned.

The invention relates to improvements concerning mechanical apparatus comprising, within a stator or casing which may or may not be fluid-tight, an assembly of rotary members whose motion causes, or is caused by, a change in volume of various spaces defined by the rotary members together. The invention has particular application to boosters, compressors, gas, steam or heat engines, vacuum pumps, liquid or gas pumps, internal combustion engines, and the like.

This device is essentially characterized by the fact that most of the lines and surfaces in contact between fixed and movable components, or between various moving parts, are localized upon the periphery of said movable components.

This structural characteristic mainly entails the reduction or even the practical elimination within the device, of the drawbacks of pollution or fouling which may result from the depositing of impurities contained in fluids flowing through the device or from deposits left by the varying degrees of lubricant-combustion etc.

Said characteristic also facilitates rapid access to essential components of said device and, hence, cleaning or possibly replacing of parts.

This invention is an improvement over the invention disclosed in U.S. Pat. No. 2,935,027 and relates to such apparatus in general and in particular to a form of such apparatus consisting essentially of a combination of a casing which may or may not be fluid-tight containing a cylindrical rotor, which can turn on its axis and contains a circumferential peripheral annular groove, a plurality of sets of blades extending transversely of this groove and possibly having the same depth as the groove, also fitting into the groove, and at least one generally cylindrical rotary shutter wheel usually smaller in diameter than the rotor, and with its axis of rotation parallel to that of the rotor. These shutter wheels, whose thickness is preferably slightly less than the width of the groove are provided with at least one recess or track which, during the preferably synchronised, rotation of the rotor and the shutter wheel or each shutter wheel, permits the blade or each blade in the groove to pass freely beneath the shutter wheel. The generated surface or envelope of the shutter wheel can either rotate a short distance from the bottom of the groove or roll on the bottom of the groove without slipping.

If both the periphery of the shutter wheel and the bottom of the groove are provided with toothed rings, such an arrangement may permit the shutter wheel or each shutter wheel to be driven by the rotor itself if the fluid utilized is liquid or gaseous with lubrication.

This kind of drive can equally well be achieved in most cases by a set of gears outside the system coupled not to toothed rings of the shutter wheels and of the bottom of the groove but to shafts of the shutter wheels and to a shaft of the rotor, in such a manner as has been done, for example, in the apparatus of U.S. Pat. No. 2,935,027 over the invention of which this invention is an improvement. The casing may be fixed wholly or partly mobile. The latter case may arise if part of the casing is formed by an endless belt which encloses part of the rotor and, being applied to the rotor periphery, turns with it, as described for one type of fan suitable more particularly for ventilating or de-dusting installations or pneumatic conveyors for substances in powder or granular form, in United States Pat. No. 2,829,925.

In most of the apparatus types mentioned above and in apparatus of similar design it is very important to provide as perfect a seal as possible between the various compartments whose volumes are variable and between each of these compartments and the outside of each assembly.

The invention will now be described by way of example with reference to the accompanying drawings in which.

Figure 1:
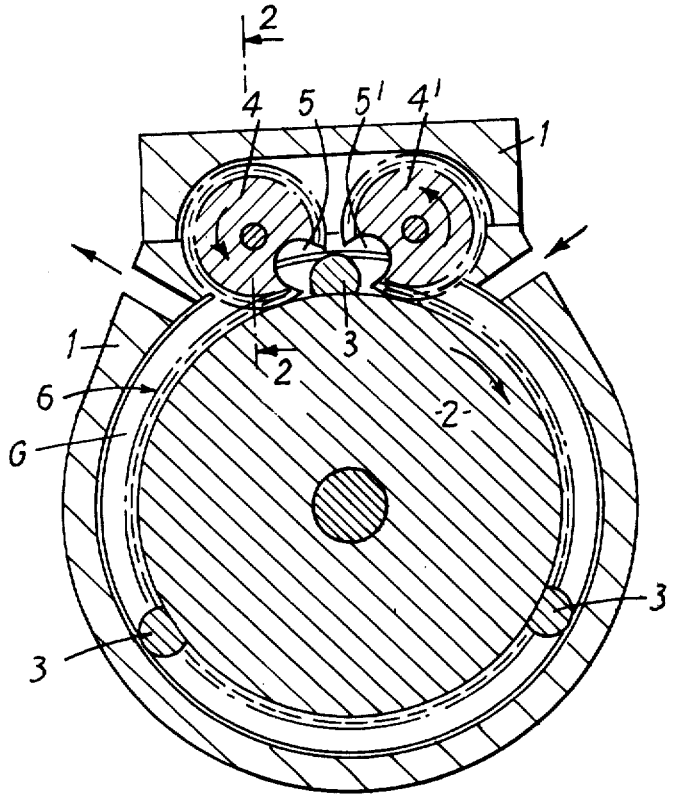
FIG. 1 is a cross-section through a mechanical system according to the invention.
Figure 5:
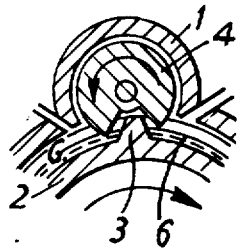
FIGS. 3 to 6 show cross-sections through several modified shutter wheels.
Figure 2:
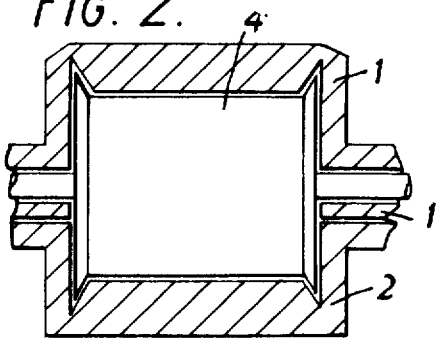
FIG. 2 is an enlarged longitudinal section, taken along the line 2—2 in FIG. 1, through a shutter wheel of the system.
Figure 3:
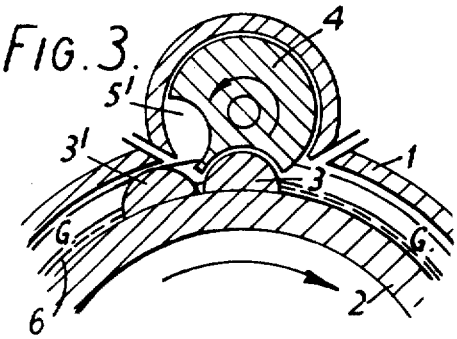
Figure 7:
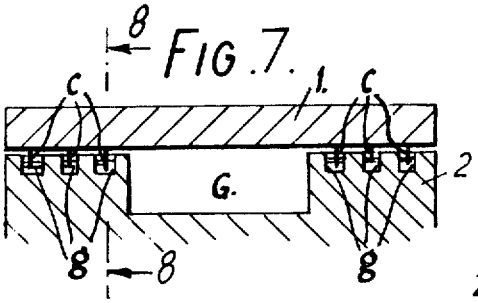
FIG. 7 is a section through a part of a modified rotor in a plane containing the axis of rotation of the rotor.
Figure 8:
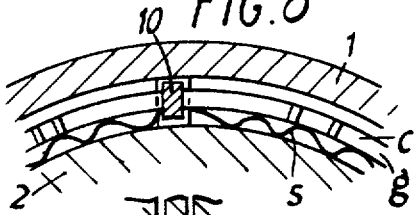
FIG. 8 is a section, taken along the line 8—8 in FIG. 7, through the rotor.
Figure 9:
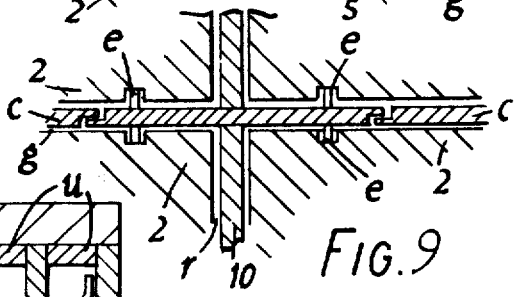
Figure 10:
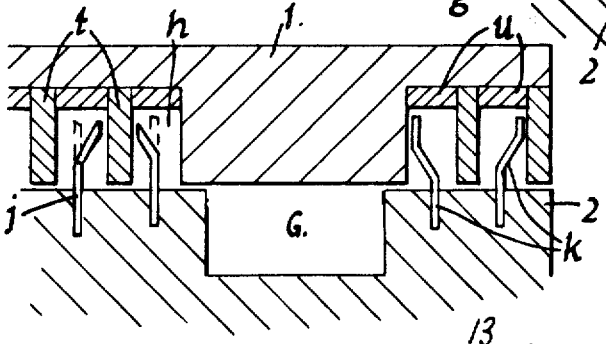
Figure 12:
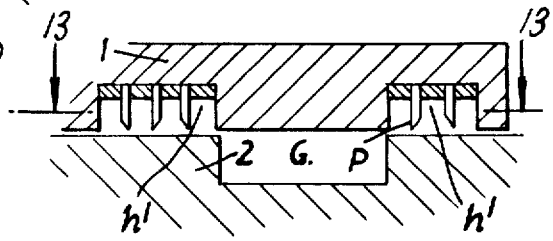
Figure 11:
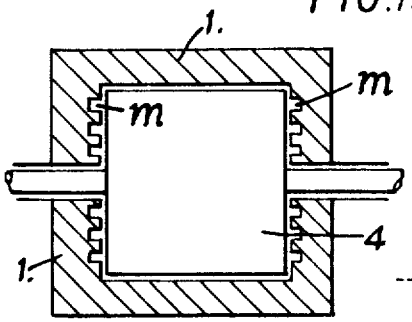
Figure 13:
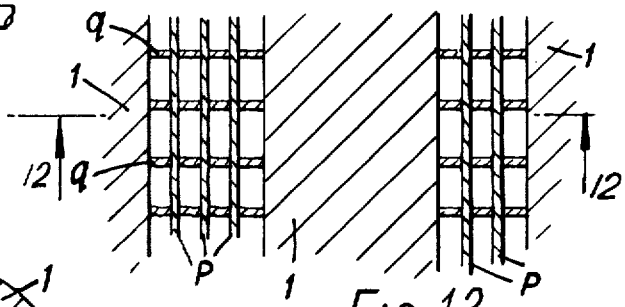
Figure 14:
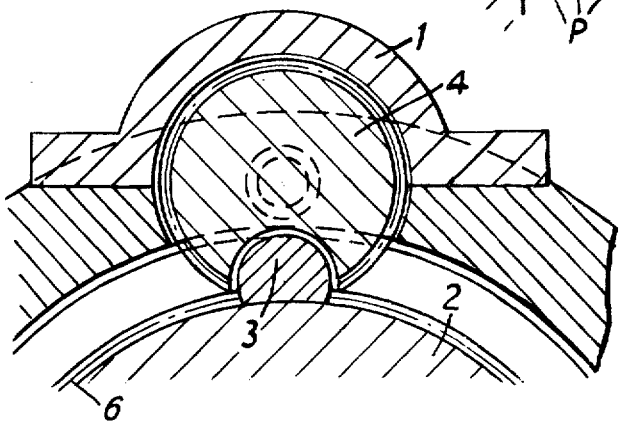

FIG. 9 indicates in detail one possible construction of rings shown in FIGS. 7 and 8;

FIG. 10 is a section through a part of another modified rotor in a plane containing the axis of rotation of the rotor;

FIG. 11 is a view similar to FIG. 2 of a modified shutter wheel;

FIG. 12 is a view similar to FIG. 10 of another rotor and is a section on the line 12—12 of FIG. 13;

FIG. 13 is a section on the line 13—13 of FIG. 12,

FIG. 14 is a section similar to FIGS. 3 to 6 indicating the system of driving the rotor and shutter wheels and showing one type of shutter wheel housing cover of the shutter wheel, FIG. 15 is a section in a plane passing through the rotational axis of the rotor wheel and the axis and the blade 3 situated in FIG. 1, between the shutter wheels 4 and 4'. Here the blade 3 is entirely in longitudinal section, the rotor 2 as well as its shoulders, its body, and a part of its middle portion (groove G) are also in longitudinal section, but the right-hand part of the groove G is viewed to show the toothed crown which engages that of the shutter wheels 4, 4'.

The following description and the associated drawings of each of the members or sets of members considered will demonstrate the principle of the invention and possible ways of realising its various features, which can be used together or in groups or separately according to the results required.

In the drawings, referring to FIG. 1, there is shown a casing 1 which is preferably fluid-tight and contains a disc or rotor 2 which can turn on its axis and contains a peripheral groove G. A number of blades 3 extends from one axial edge of the groove to the other and preferably corresponds in height to the depth of the groove. Fitting into the groove are at least two abutments 4 and 4' which preferably are smaller in diameter than the rotor 2 and have their axes of rotation parallel to the axis of the rotor. The shutter wheels 4, 4', whose width is preferably slightly less than the width of the groove G, are provided with at least two recesses 5, 5' respectively, which, during the rotation of the rotor 2 and each shutter wheel 4 or 4' permits the or each blade 3 in the groove G to pass freely beneath the shutter wheels. The generated surfaces of the shutter wheels roll on the bottom 6 of the groove G without slipping.

A seal is formed between two zones of the groove G and is generally separated by a single shutter wheel. This type of seal is improved by increasing the number of shutter wheels 4, 4' as shown in FIG. 1, so that the blade 3 leaving the recess 5 in one shutter wheel 4 engages in the recess 5' in another shutter wheel 4' immediately following the shutter wheel 4 in the direction of rotor rotation. One or more other shutter wheels (not shown) may be provided one after the other to increase the length of the leakage lines between two unequal pressure zones situated on each side of a set of shutter wheels 4 and 4'.

The seal at the boundray between those zones of the groove G on each side of a set of shutter wheels as described above, can be substantially increased in some cases by modifying the shape of the exterior (generally represented by a parallel-ended right cylinder) of the obturator shutter wheel or each shutter wheel. The two ends of each shutter wheel may, as shown in FIG. 2, be greater in diameter than its cylindrical body and may be connected to the body by respective portions each having a conical surface, so that the two ends of the shutter wheel have a chamfered shape.

Referring to FIG. 2, this feature increases the sealant effect of the shutter wheel since fluid flowing along the sides of the groove G passes into eddies caused by the chamfers on the shutter wheel ends as it tries to flow between the shutter wheel ends and the side walls of the groove G.

If the shutter wheel ends are chamfered as described above, the bottom of the groove G will contain slots along each side to permit the chamfered shutter wheel ends to pass freely with a minimum of clearance.

If, during the motion of the rotor 2, some of the fluid concerned (for example, gas in the case of a compressor) tends to infiltrate between the inside surface of the casing 1 and the top of a blade 3, it is advisable, instead of having a single blade 3, to provide two or three blades 3, 3' etc., one after the other (FIG. 3) in a manner similar to that described above with reference to shutter wheels or shutter wheel sets. If so, the recesses or tracks 5' in the shutter wheel or each shutter wheel must correspond in number and shape to the blades separating the different compartments of the groove G.

The shape of the blades must be selected according to the application of the apparatus and the fluid used (gaseous, liquid or semi-liquid fluid).

Figure 6:
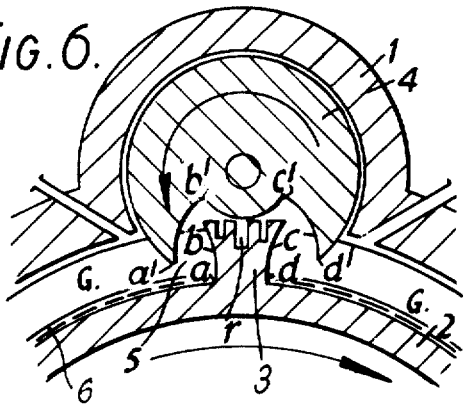

The cross-section of the blades may be that of simple conventional gear teeth (FIG. 5), semi-circular (FIG. 1, 3 and 4), or a well defined shape such, for example, as that shown in FIG. 6 in which the blade crown which comes close to the inside surface of the casing 1 has substantially the same radius of curvature as the rotor 2 where its diameter is largest and is substantially concentric therewith.

Referring to FIG. 6, the corresponding portion of each shutter wheel, that is to say, the bottom of each recess 5 which is to allow the blade to pass, is shaped so that it and the blade crown can turn past one another about their respective axes without rubbing or rolling, i.e. with the minimum of clearance compatible with satisfactory operation of the system. The upstream and downstream blade surfaces taken in the direction of rotation are both so curved that the edges *b* and *c* of the tooth are very close, when the system rotates, to the curves *a'–b'* and *c'–d'* which define the interior of the cross-section shutter wheel recess. The same may apply to the edges *a'* and *d'* of the shutter wheel, which, during rotation, are very close to the curve *a–b* and *c–d* defining the blade cross-section, depending on whether the blade is leaving or entering the shutter wheel.

The shapes of the various surfaces of the blade and respective surfaces of the shutter wheel which contact each other and the relatively high rotational speeds of the moving members, help to improve the seal between the various compartments of the groove G.

Whatever the shape of the blades, they must oppose the passage of fluids between the compartments at different pressures, particularly while the blades are moving beneath the generally cylindrical inside wall of the casing 1.

If the fluid is gaseous and motion takes place without lubrication, a particular shape of blade must be used in order to compensate for the absence of lubrication (which would otherwise greatly improve the seal) whereby the blades are provided with parallel axially extending slots *r* arranged in shoulders of the rotor 2 and running about the shoulders.

Figure 4:
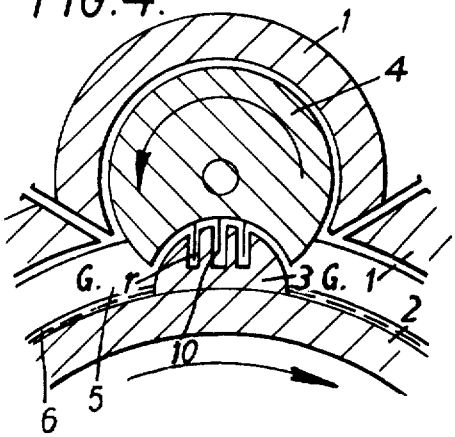

Referring to FIGS. 4 and 8, if the fluids are liquid, or if they are gaseous but used with lubrication, these slots are preferably more distinct, with appropriate strips 10 arranged movably in them along planes passing through the rotational axis of the rotor. Centrifugal force tends to force the strips 10 on to the inside surface of the casing. If necessary, a leaf spring *s* may be placed in the bottom of each slot *r* in order to urge the strips 10 out of their housing on to the inside wall of the casing 1 even when the rotor 2 is stationary. If so, the inside surface of the casing 1 may advantageously be provided with a lining of wear-resisting material.

Referring to FIGS. 4 and 6, these strips 10 behave like the piston rings or scraper rings currently used in mechanical piston and cylinder units. Advantageously, to remove any risk of the strips 10 jumping out of their housing during rotation, either when the blade 3 enters the shutter wheel recess 5 or when the blade leaves the recess 5, they may, instead of being only as long as the blade 3 (that is, as long as the width of the rotor groove G) extend beyond the walls of the groove G, possibly as far as the two outer ends of the rotor shoulders, so that they can bear permanently on the entire width of the inside surface of the casing 1.

The axial end faces, or sides, of the shutter wheels are generally smooth surfaces which are very close to the side walls of the groove G and there is very little space between the shutter wheels and these walls for the fluid tending to move between two zones at different pressures, situated on each side of a shutter wheel or shutter wheel set in the rotor groove. When the apparatus is operating with lubrication and a gaseous fluid or with a liquid fluid, the seal may be further improved by adjustment of the relative position of members and then running them in an appropriate fashion.

Each of the casing portions enclosing a shutter wheel may contain in its end walls, opposite the end faces of each shutter wheel, slots parallel to one another and to an imaginary line joining the rotational axis of the rotor to the axis of the shutter wheel concerned. This slotting of the casing 1 with slots *m* opposite the shutter wheel end faces is illustrated in FIG. 11.

If the various members are to move without any lubrication, these slots in effect form labyrinth seal systems which may advantageously be retained even if the motion of the members is carried out with lubrication. This system increases the resistance to fluid tending to move between two zones at unequal pressures on each side of a shutter wheel or abutment set.

Referring to FIGS. 1, 3 to 5, 8 and 9 the various featuresd mentioned above relate to the seal in planes perpendicular to the rotational axis of the rotor and, in particular, between the various compartments of the groove G. It is also necessary to reduce and even remove the risk of leakage in other directions.

If the casing 1 has an internal generated surface (concentric with the rotor cylinder) substantially equal in axial length to the rotor cylinder, leaks may occur between the exterior and the zone between the inside casing surface and the outside rotor surface on each side of the groove G.

This type of leak is particularly likely if the casing 1 is not closed in a fluid-tight manner at each end, for example by end pieces containing orifices (with stuffing-boxes or any other seals) to permit the passage and free rotation of a rotor shaft and possibly to support this shaft.

The two above-mentioned cylindrical shoulders on the the rotor 2 on each side of the groove G are provided with slots or grooves *g* (FIGS. 7, 8, 9) which are narrower and shallower than the main groove G and circular and extending around the entire circumference of each shoulder. Each groove *g* contains a ring *c* which is similar in general shape to the piston rings or scraper rings currently used in mechanical piston-and-cylindr units. Each ring *c* is advantageously formed of a plurality of cylindrical sectors or arcuate portions assembled one after the other in the groove *g* in such a way that they are easy to insert and each end of a portion overlaps an end of the next portion and an end of the preceding portion.

The dimensions of the portions are such that the rings *c* can move radially in their grooves *g* and therefore tend to bear on the inside casing surface under the influence of centrifugal force during rotation of the rotor 2. To overcome or reduce the risk of any sector shifting around the rotor 2 in its groove *g* for any reason, each sector may be provided on one or two lateral walls thereof with lugs or strips *e* which may slide in appropriate slots in the walls of the associated secondary grooves. The slots are arranged radially in relation to the rotor. The lugs or strips *e*, are useful if the assembly conditions for the various elements of the device allow, to reduce circumferential sliding of one or more of the portions which may cause jamming of the ring *c* and prevent the ring from fulfilling its sealing function by fanning out the ring *c* under the influence of centrifugal force.

Referring to FIGS. 4 and 7 to 9 as already described with reference to the sealing strips which may be provided at the tops of the blades 3, the lateral sealing portions mentioned in the preceding paragraph may be provided, at the bottom of the grooves *g*, with springs *s* (for example, undulating leaf springs) or equivalent means to bring them to bear on the inside casing surface even when stationary.

Referring to FIGS. 4 and 7 to 9 the arrangement described above may advantageously be so arranged that any wear due to friction of the rings *c* against the inside wall of the casng is distributed uniformly over the entire area of this wall. This may, for example, be achieved by combining the effects of friction, against the inside casing wall, of the rings *c* and of the strips 10 on the tops of the blades 3, if these strips 10, instead of being only as wide as the blades, run along the entire length of the generatrices of the rotor cylinder (including the blades and shoulders). In this case, the strips 10 and rings *c* straddle one another.

To this end, and to enable each of them to maintain contact with the inside stator surface without interfering with the other, they may both be provided with mutually opposite notches so arranged that the effect of centrifugal force (possibly combined with any subjacent springs *s* with which the strips and/or the rings are equipped) bring them to bear on the inside wall of the stator enveloping the rotor. The lattice-like seal (FIGS. 8 and 9) formed in effect by this combination of rings *c* with strips 10 creates highly fluid-tight zones on each side of the groove G.

A similar result may be obtained to the above by reversing the arrangement just described. Circular slots *h* (FIG. 10) are provided, not in the rotor shoulders, but actually in the surface of the casing 1, on each side of the region of the casing 1 surrounding the groove G.

The slots *h* may be obtained in practice, for example, by forming on each side of the region of the casing 1 enveloping the groove G (therefore, as it were, opposite this groove G), within the casing 1, which will have an internal diameter larger than the rotor diameter, a stack of flat circular washers *t* and *u*, the median plane of each washer being perpendicular to the rotational axis of the rotor.

The external diameter of each washer is substantially equal to the internal diameter of the casing 1 (that is, on each side of the region of the casing 1 immediately surrounding the rotor groove G). However, the internal diameter of every second washer (the washers *t*) in the stacks will be slightly greater than that of the rotor 2. The other washers *u*, which act as ordinary spacers, are substantially greater in internal diameter than the washers *t*. All the washers *t* and *u* so arranged form, on each side of the region of the casing 1 enveloping the rotor groove G, groups of annular chambers *h*.

The two cylindrical shoulders on the rotor 2 on each side of its groove G are provided with relatively thin annular fins *j* which are preferably flexible. The centre of each fin lies on the rotational axis of the rotor 2 and, at least when stationary, the fins *j* are arranged in mutually parallel planes perpendicular to the rotational axis of the rotor 2.

Each of the fins *j* on the rotor 2 is fixed to the body of the rotor 2 and is so arranged that it projects into one of the annular chambers *h* just described.

During rotation, centrifugal force tends to keep each fin *j* in a plane perependicular to the rotational axis.

The pressures prevailing in the groove G are exerted on the walls of the fins *j* and tend to force these fins, which are flexible, on to one of the side walls of the annular chambers *h*. APpropriate lubrication, for helping the fins *j* to slide on the side walls *t* of the annular cahmbers *h*, contributes to the seal between the rotor and the casing 1, leakage being therefore neutralised due to the closing of each chamber by the flexible diaphragm formed by the fin *j*.

The efficiency of the system described can be increased by chamfering one or both sides of the outer edges of the rotor fins *j* and so substantially widening the area of friction between the fins *j* and the wall of each annular chamber. The tip of the chamfer and the increased length of the leakage path distinctly improve the lateral seal.

The same purpose is served by making the rotor fin not flat but, as shown at *k*, to have a more or less conical portion, that is to say, inclined to the plane along which thin fin *k* is normally inserted into the rotor 2, intermediate two flat portions. The outer face of the fin *k* may alternatively be chamfered and be applied in this state to the washer *t* of the annular chamber *h*. Alternatively the fin *k* may be straightened close to this washer and resume a flat band shape perpendicular to the rotational axis of the rotor 2. This flat band, owing to the pressure from the fluid tending to flow out of or into the groove G, bears on the washer *t* of the annular chamber *h* and therefore tends to close this chamber.

The conical portion of the fin *k* is preferably inclined in the direction of decreasing pressure. If, as is generally the case, each compartment of the groove G is subjected to pressure variations, positive and negative, during each revolution of the rotor 2, the direction of inclination of successive conical fins *k* may advantageously alternate from one annular chamber *h* to the next and possibly two or more oppositely inclined fins *k* may be arranged back-to-back in each chamber *h*.

The arrangements described above may make it possible, in some cases, to eliminate the fluid-tight end pieces which are generally necessary on known rotary apparatus utilising or causing the motion of fluids under pressure.

If end pieces must for some reason be retained, the need to seal them may be substantially reduced by means of the arrangements described above.

If the end pieces are retained the annular chambers *h* furthest from the groove G may use the inside walls of the end pieces as their end side walls.

In contrast to what occurs in most known rotary apparatus, in which the rotating rotor rubs, often fairly hard, on a large contact area on the end pieces of the apparatus, in the present invention friction is limited in the systems described above to a small number of narrow bands, which are on the periphery of the rotor in a zone in which centrifugal force makes lubrication particularly powerful and effective.

Referring to FIGS. 12 and 13, if the apparatus operates without lubrication of the rotary members, except for the driving shafts, as may occur, in particular, if a gaseous fluid is used, annular casing chambers *h'* (FIG. 12) are provided, fairly similar to the chambers *h* described above. The surfaces of walls *p* within the chambers *h'* are very close to the generated surface of the cylindrical rotor shoulders. The innermost end of the walls, close to the rotor 2, may advantageously be chamfered in a single direction or each in one of two directions, to form a labyrinth seal system on each side of the rotor groove G (FIG. 12). The cylindrical shoulders on the rotor, however, preferably have no fins and are smooth.

The efficiency of a labyrinth seal system of this kind is greater if the various annular chambers *h'* are partitioned by means of strips *q* over all or part of their depth, these strips *q* being situated in planes extending through the rotational axis of the rotor 2 of the device. Such a lattice arrangement makes it possible in most cases to prevent fluid from being entrained around the rotor in each annular casing chamber *h'* and so eliminates the risk of communication between two portions of the groove G at different pressures.

The system described above may make it possible to substitute perforated end pieces for fluid-tight end pieces. If the rotor shoulders on each side of the groove G are long enough, and if the labyrinth seals on the casing 1 cover the entire length of the rotor shoulders, the seal between the groove G and the exterior of the apparatus concerned is equivalent, in the majority of cases, to the seal provided by fluid-tight end pieces. The results obtained by means of the arrangements described above are in any case at least comparable, in most cases, to those obtained in the majority of conventional applications for current labyrinth seals, even at high pressure.

The elimination of fluid-tight end pieces and their replacement by open or perforated end pieces similar to those of conventional electric motors may make it possible to cool the rotor 2 with ambient air. If the rotor 2 is hollow and formed, for example, by a bottomless cylinder and the cylinder is connected to the driving shaft by arms in the form of propeller blades, the rotation of the rotor 2 will produce an air stream parallel to the shaft. This will have the effect of cooling both the rotor 2 itself and, by means of the resulting draught, the rest of the apparatus.

The casing 1 may be cooled by means of water jackets. This is also possible for the rotor 2 if it is hollow and tight, in which case the water may be supplied and discharged through the driving shaft, which is for this purpose hollow. It will be appreciated that the driving of the shutter wheels by means of toothed rings 21 distributed along the bottom of the rotor groove G and around the periphery of each shutter wheel is regarded not merely as one means of synchronising the movements of these various components, but also as one of the improvements for the purpose of increasing the seal between compartments in the groove G on each side of each shutter wheel.

Referring to FIGS. 1 and 14, this driving by means of internal toothed rings shows how the appliances concerned, at least if lubricated or if intended for liquids, are similar to gear pumps of which one component (in this case the rotor 2, by means of the bottom of its groove) comprises at least one blade 3, whose module is greater than that of the ring on the groove botton and of which only the protuberant portions are used between the groove bottom and the cylindrical periphery of the stator.

On the other hand, as explained elsewhere in the description, the or each shutter wheel has in addition to driving rings on its periphery at least one hollow limited to the recess which corresponds to the protuberant lands of the or each rotor blade.

FIG. 14 illustrates the system of driving by means of toothed gears. The casing 1 in this arrangement has that portion of the casing 1 enclosing each rotary shutter wheel made detachable from the remainder of the casing 1 as a conventional bearing cover or cap. The component members of the apparatus embodying the invention can then be assembled and dismantled as easily and rapidly as those of conventional electric motors.

In FIGS. 3 to 6 and 14, the numeral 6 denotes the bottom of the groove G.

The removal of an shutter wheel cover or covers makes it easy to remove the shutter wheel or shutter wheels and the removal of one end piece makes it possible to take out the rotor 2 as easily as the rotor of an electric motor.

I claim:

1. A rotary device comprising a cylindrical rotor arranged for rotation about its axis and having over half the length thereof a peripheral annular groove and a plurality of sets of at least two blades within said groove extending from one edge of said groove to the other, having the same depth as said groove, and dividing said groove into a plurality of fluid-tight segmental channels bounded at the periphery of the rotor, a hollow fixed generally cylindrical stator closely surrounding said rotor and said groove thereby closing said channels and being formed with at least one set of at least two closely spaced cavities distributed in a zone overlying and communicating with said groove, at least one set of at least two cylindrical shutter wheels, arranged in series of at least two, one immediately after the other wholly mounted in respective cavities of said stator to be rotatable about axes parallel to the axis of said rotor in engagement with the groove, and projecting into said groove so as effectively to subdivide each channel into two portions varying in length during relative rotation between said rotor and said stator, adjacent portions being at different pressures from each other, said shutter wheels each being formed with a recess in its periphery arranged in number to receive said blades and in shape so that a bottom of the recess and a crown of the blade are of complementary shape to turn past one another about their respective axes without rubbing or rolling, and including said rotor being coupled to said shutter wheels so that the recesses allow the passage of each blade passed the shutter wheels, said stator and said shutter wheels forming a substantially fluid-tight seal with the blades and with portions of a peripheral surface of said rotor at each side of the groove, means being provided for sealing said groove from the atmosphere, first conduit means communicating with said groove for intermittently admitting a working fluid to said channels, second conduit means for intermittently removing said working fluid from said channels and end portions are provided which are associated with each of said shutter wheels and which have parallel faces and are larger in diameter than a body of said shutter weels to define shoulders thereon, a bottom of said groove and the internal surface of each portion of the stator covering each shutter wheel being formed with slots along each side to permit chamfered ends of the shutter wheels to pass with a small clearance, whereby the system is arranged to undergo unrestrained rotation.

2. A rotary device according to claim 1, comprising cylindrical shoulders which widen the rotor on each side of the peripheral groove therein, the stator being widened to surround the rotor completely, said shoulders being formed with annular slots parallel to one another and to the peripheral groove, the slots extending over almost the entire width of the shoulders.

3. A rotary device according to claim 1, wherein said stator has a cylindrical inside surface provided with annular slots therein and end walls of said annular slots have an internal diameter slightly greater than the external diameter of the rotor.

4. A rotary device according to claim 3, wherein said annular slots are provided with a plurality of annular secondary walls having the same depth as said annular slots, being disposed in planes perpendicular to the axis of said rotor and being chamfered on one or both sides near the periphery of said rotor.

5. A rotary device according to claim 3, wherein said annular slots have side walls, one or more annular flexible sealing fins fixed to and around said shoulders of the rotor on opposite sides of said groove and inserted between said side walls to bear there against and to bend and unbend without retraint.

6. A rotary device according to claim 1, wherein each shutter wheel has a releasable cover plate secured to the stator and permitting inspection and removal of that shutter wheel, as well as dismantling of the engine by removal of the rotor from an end of the machine.

7. A rotary device according to claim 1, wherein each shutter wheel is provided with two recesses in radial juxtaposition in relation to that shutter wheel, the recesses being arranged to mesh with a set of two respective blades closely spaced from each other and together separating two channels.

8. A rotary device according to claim 2, wherein said annular slots are provided with arcuate sectors each of a plurality of elements which compliment one another, and each part tends, under the influence of centrigual force assisted by springs underneath the assembly, to bear on an inside surface of said casing.

9. A rotary device according to claim 4, wherein labyrinth seals are provided between consecutive zones at different pressures near the ends of shoulders of said rotor and are partitioned by means of strips occupying at least part of the depth of said annular slots, of said stator, said strip being arranged in planes passing through the axis of said rotor to form in combination with said annular secondary walls inserted in said annular slots a honeycomb structure for increasing the efficiency of said seals.

10. A rotary device according to claim 8, wherein each sector is provided at one or two lateral walls thereof with lugs or strips slidable in slots in the walls of associated secondary grooves to eliminate or substantially reduce the tendency of any sector to slide in the annular slots all about the rotor, said slots in the walls of secondary grooves being arranged radially in relation to the rotor.

11. A rotary device according to claim 1 for use with a liquid fluid, or with a gaseous fluid with lubrication, wherein the rotor is arranged to drive the shutter wheels by means of toothed rings disposed around the periphery of each shutter wheel and around the periphery of the bottom of said groove, the profile of each blade matching that of each recess to permit smooth and unrestrained rotation.

* * * * *

PO-1050
(5/69)

UNITED STATES PATENT OFFICE
CERTIFICATE OF CORRECTION

Patent No. 3,977,817 Dated August 31, 1976

Inventor(s) Jean Andre Monteil

It is certified that error appears in the above-identified patent and that said Letters Patent are hereby corrected as shown below:

Column 2, delete lines 39-47.

Signed and Sealed this

Twenty-first Day of December 1976

[SEAL]

*Attest:*

RUTH C. MASON
*Attesting Officer*

C. MARSHALL DANN
*Commissioner of Patents and Trademarks*